United States Patent [19]

Falgout, Sr.

[11] Patent Number: 4,928,776

[45] Date of Patent: May 29, 1990

[54] DEVIATION CONTROL TOOL

[76] Inventor: Thomas E. Falgout, Sr., Rt. 2, Box 11B, Youngsville, La. 70592

[21] Appl. No.: 264,617

[22] Filed: Oct. 31, 1988

[51] Int. Cl.[5] ..... E21B 7/08

[52] U.S. Cl. ..... 175/45; 175/48; 175/73; 175/74

[58] Field of Search ..... 175/73, 74, 61, 45, 175/48, 256, 320, 321; 285/118, 223, 93, 184

[56] References Cited

U.S. PATENT DOCUMENTS

| | | | |
|---|---|---|---|
| 2,402,238 | 6/1946 | Carpenter | 175/45 |
| 2,819,039 | 1/1958 | Lindsay et al. | 175/73 |
| 3,457,999 | 7/1969 | Massey | 175/73 |
| 4,220,214 | 9/1980 | Benoit | 175/74 |
| 4,374,547 | 2/1983 | Nguyen et al. | 175/45 |
| 4,596,293 | 6/1986 | Wallussek et al. | 175/45 |
| 4,597,454 | 7/1986 | Schoeffler | 175/73 |
| 4,655,299 | 4/1987 | Schoeffler | 175/48 |

*Primary Examiner*—Bruce M. Kisliuk
*Attorney, Agent, or Firm*—John D. Jeter

[57] ABSTRACT

A drill string deflection tool is arranged to function as a segment of drill string. An upper and a lower portion telescope together to form a mid-section with limited telescoping movement and limited angular deflection of the axes of the opposite ends. Axial load compresses the tool and a cam and fulcrum arrangement deflects the tool when it is axially compressed. The tool extends axially when pulled in tension and the axis becomes straight. Drilling fluid pressure acts on rams in the tool to lock it in whatever state exists when pressure is applied. The locking mechanism acts upon the drilling fluid channel to cause a pressure drop, detectable at the surface, that indicates the state of the tool downhole.

4 Claims, 2 Drawing Sheets

DEVIATION CONTROL TOOL

This invention pertains to well drilling tools used to control the deviation of a drill head from the path of the preceding well bore. More particularly, this invention pertains to apparatus used as part of the drill string to bend, or deflect, the axis of the drill string.

BACKGROUND

It is often necessary, for reasons well known to those in the drilling art, to control the course of a progressing well bore being drilled. In the past, unwanted deviation from vertical was of prime concern. More recently, well bores were directionally drilled when necessity dictated, to drill into otherwise inaccessible formations. With more sophisticated equipment, directional drilling is now practiced for convenience as well as economy.

For well bore deflection purposes, bending the drill string about a transverse axis fixed to the drill string can be done with rugged and reliable machinery. The related drilling practice generally requires a drilling motor below the bend or a lateral jet in the drill head. The drill string bend can be permanent in the form of a "bent sub" but that system is not considered suitable for straight hole drilling. Once a well bore is deflected from an original path, the "reach" of hole subsequently drilled usually does not require continued deflecting effort. The drill string is conventionally tripped from the hole to remove the bent sub until the next time deflection is needed.

There has been a recognized need for some time for the ability to change the downhole assembly from a directional configuration to a straight hole drilling configuration, and ideally to reverse the process, without tripping the drill string. This need has produced "knuckle joint" tools that have hinge means to accomplish the effect of a bent sub. The ideal objective of commanding the sub to accomplish the bent result by simple manipulation of drilling controls at the surface has received some effort, with some success, in recent years, and this invention is an effort to further that art. In the drilling arts, simplicity generally results in greater reliability and this invention is directed to a deflection tool of simple construction and simple controls.

It is an object of this invention to provide a drill string deflection tool that can be controlled by manipulation of the drilling controls at the surface to provide a straight drilling or a deflected drilling configuration of the downhole assembly. It is a further object to cause the change in configuration by axial manipulation of the drill string and to lock in the selected configuration by manipulation of drilling fluid flow controls.

It is another object of this invention to provide a downhole drill string deflection apparatus that can influence the resistance to the flow of drilling fluid such that the configuration of the downhole assembly will be indicated at the surface by the pressure-flow relationship of the drilling fluid circuit.

SUMMARY OF THE INVENTION

A drill string deflection tool has a body arranged to function as a segment of a drill string. The body has upper and lower portions that telescope together in a mid-section to shorten the body when axially compressed and to lengthen the body when pulled axially.

When the body is compressed, cam surfaces on each portion engage and cooperate to radially deflect the longitudinal axis of one portion relative to the other. A fulcrum in the telescoping mid-section, axially displaced from the cams, reacts to the radial displacement to cause an angular deflection of the axis of one portion relative to the axis of the other.

Transverse lock bolts are situated in the male part of the telescoping mid-section to extend radially to engage cooperating sockets in the inner wall of the female part to lock the body in the configuration that exists when fluid pressure is established. The lock bolts have piston ends in fluid communication with drilling fluid channels, that extend axially through the tool, to extend the lock bolts by drilling fluid pressure. The lock bolts are, preferably, cam shaped to cooperate with the socket shapes to urge the bolts inward when axial forces on the tool urge telescoping movement and drilling fluid pressure is low.

The piston ends of the lock bolts are situated to intrude radially into the drilling fluid channel to cause fluid flow resistance when the lock bolts are radially inward. The fluid resistance can be detected at the surface and gives an indication of the configuration of the tool.

DETAILED DESCRIPTION OF DRAWINGS

Some details pertaining to manufacturing and maintenance utility, such as threaded connections, weld lines and the like, are omitted in the interest of clarity of points of novelty. It can be assumed that the tool is assembled as shown with final closure completed by welding.

Figure 1A:
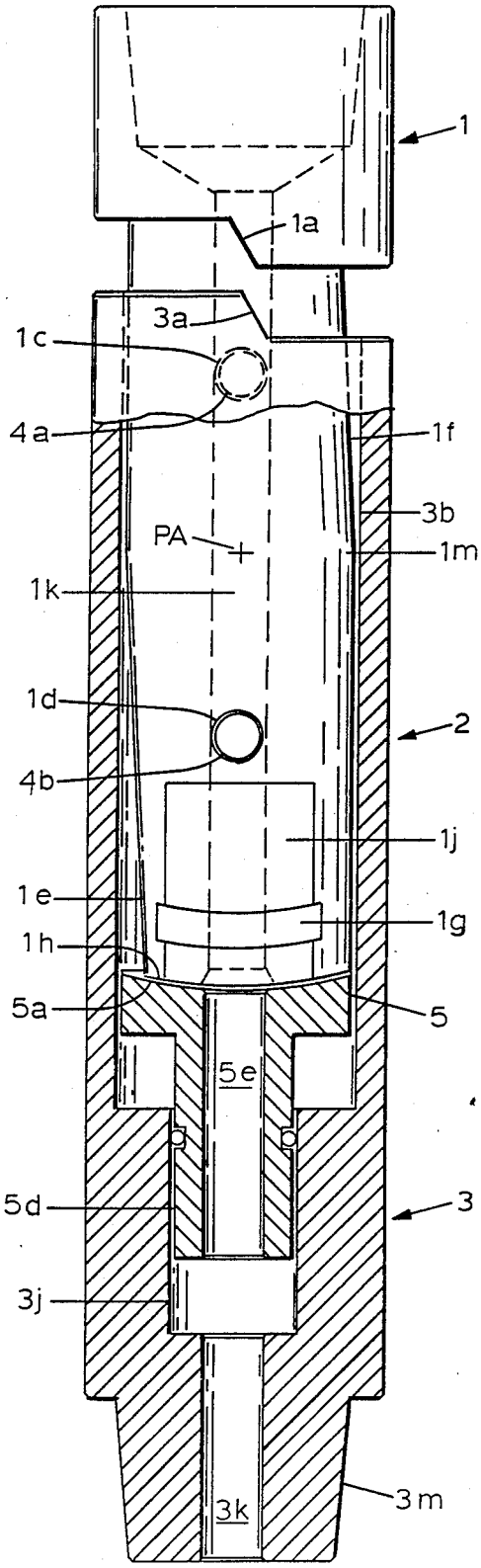
FIG. 1A is a side elevation view, mostly cut away, of the preferred embodiment of this invention.

In the drawings, wherein feature and caption consistency is maintained throughout, FIG. 1A shows the preferred embodiment as a segment of a drill string, in a straight configuration. The body is comprised of an upper, or first, portion 1 and a lower, or second, portion 3 telescopingly joined in mid-section 2. Telescope bore **3*b* accepts a reduced diameter extension of portion 1. The extension is retained in the bore by non-circular drive flat 3*g* which has face 3*e* arranged to engage face 5*c* of washpipe 5 which is fastened to portion 1**, best shown in FIG. 1B. The overall body is at maximum length.

Washpipe 5 has extension **5*d* telescopingly received in bore 3*j* and is secured to portion 1 by arcuate retaining lug 5*b* in arcuate groove 1*g*. Portion 1 and washpipe 5 move axially relative to portion 3 and portion 1 can move downwardly until first cam surface 1*a* is stopped by second cam surface 3*a*. Portion 1 can rotate in the plane of the drawing of FIG. 1A about pivot axis PA seen as a point in FIG. 1A and as a line PA in FIG. 1B. The axial location of the pivot axis is determined by fulcrum 1*m* which is simply a diameter that closely fits the diameter of the bore 3*b*. Pivoting about axis PA is made possible by diameter reliefs 1*f* and 1*e*. Pivoting relative to the washpipe is accepted by cooperating arcuate sealing surfaces 1***h* and 5*a*. The center of curvature of these sealing surfaces, and lug 5*b* and groove 1*g* is axis PA.

Figure 3:
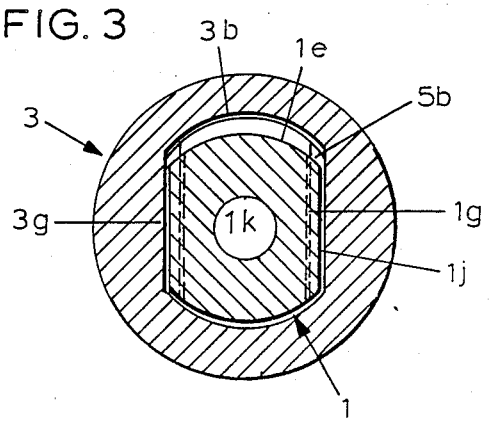
FIG. 3 is a section, taken along line 3—3, of FIG. 1B.

Rotational drive between portions 1 and 3 is best shown by FIG. 3. Non-circular flat 1*j* cooperates with a mating flat on non-circular drive ledge 3*g*. The non-circular feature has length to accept telescoping action.

The upper portion 1 is locked in the straight configuration shown by upper lock bolts 4*a* and lower lock bolts 4*b* engaging upper sockets 3*c* and middle sockets 3*d* respectively. The lock bolts 4*a* and 4*b* are sealingly fitted into and slide radially in upper cross bore 1*c* and lower cross bore 1*d* respectively. The lock bolts have piston ends 4*d* in communication with drilling fluid channel 1*k* such that drilling fluid pressure in channel 1*k* urges the lock bolts radially outward into the sockets. The lock bolts are urged radially inward by the detent action of tapered detent head 4*c* and the tapered sockets when axial forces tend to telescope the body.

Body straightening forces are produced, after the lock bolts have been radially inward and the body is pulled to full length, by application of drilling fluid pressure to extend the tapered ends of the bolts into the tapered sockets. A deflection range of less than three degrees is planned. In cases of reluctance to straighten, due to bending forces in the hole, the drill string will be slowly rotated while drilling fluid pressure is maintained until the lock bolts are fully extended.

Fluid tight connection to the continuing drill string is accomplished by tool joint connections 1*b* and 3*m*. A drilling fluid channel comprising channel 1*k*, 5*e* and 3*k* extends through the tool.

Figure 2A:
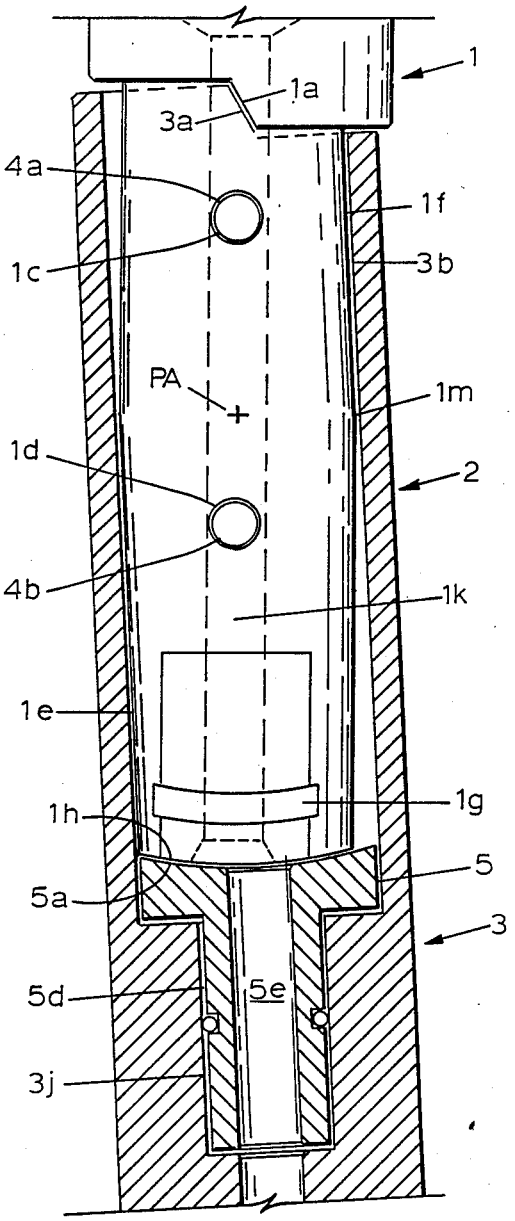
FIG. 2A is a side elevatIon view, mostly cut away, of the tool of FIG. 1A, after actuation to deflect.
Figure 2B:
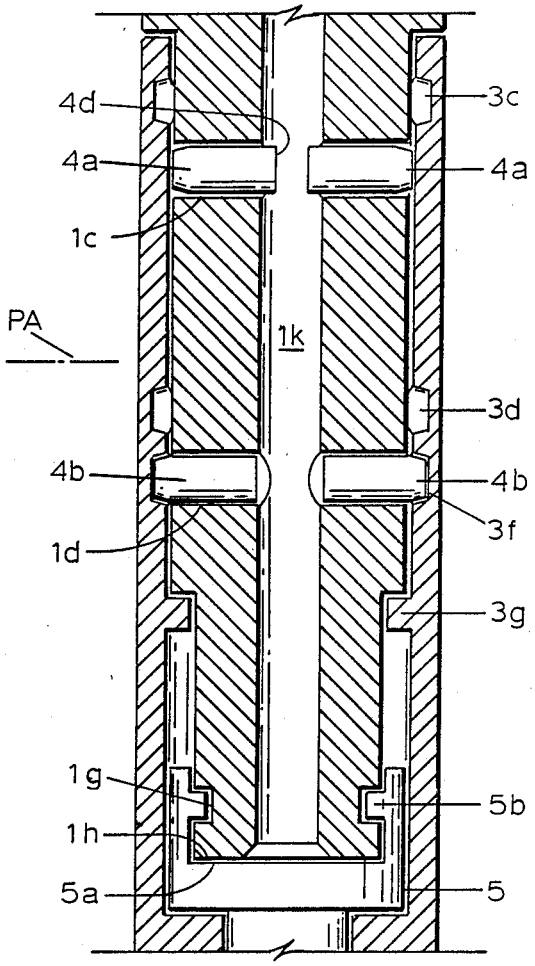
FIG. 2B is an orthographic projection, mostly cut away, of the tool of FIG. 2A.

FIGS. 2A and 2B show the tool in the deflected configuration. FIG. 2B is displaced somewhat upward from the normal position of an orthographic projection. The tool joints have been described and are not further shown.

Portion 1 has been pushed downward, cam surface 1*a* has cooperated with cam surface 3*a* to urge the two portions in opposite radial directions. The relative radial movement has operated, in conjunction with fulcrum 1*m*, to produce an angular deflection of the axis of the lower portion relative to the axis of the upper portion.

With the body telescoped to minimum length, lock bolts 4*b* are aligned with lower sockets 3*f* and are shown radially extended by drilling fluid pressure. With the cam surfaces engaged, the overall body is rigid. Lock bolts 4*a* are not needed for rigidity and serve a signal function when radially inward as shown.

Figure 1B:
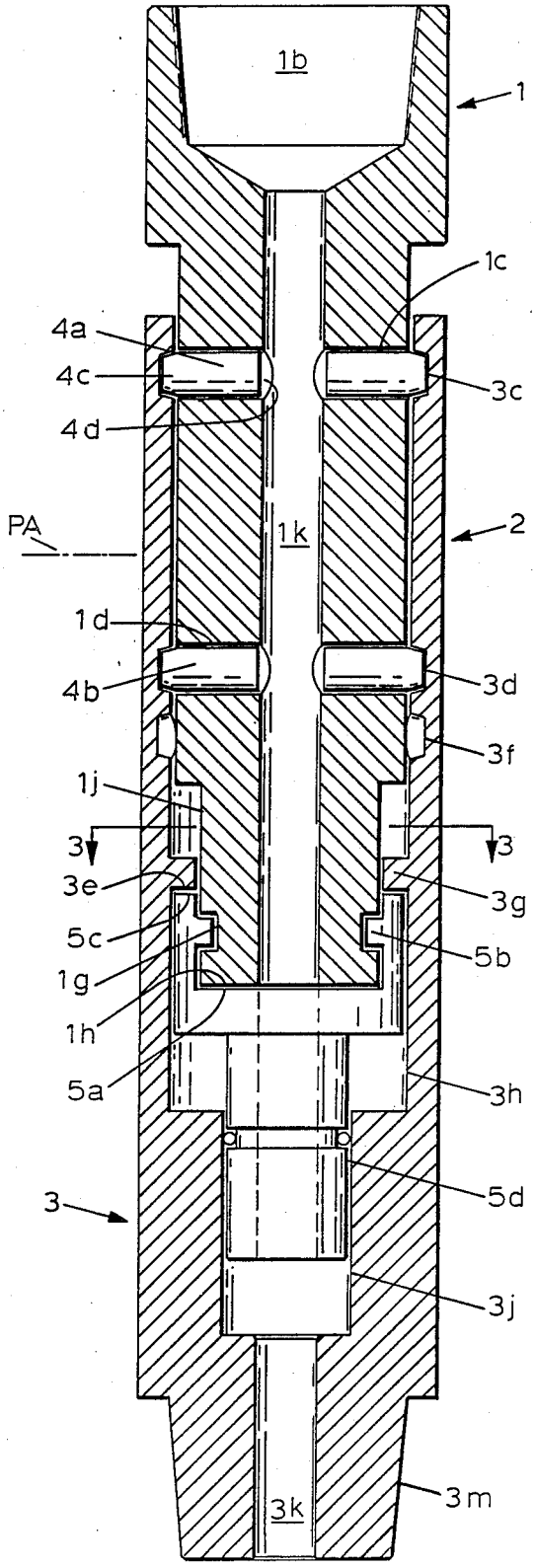
FIG. 1B is an orthographic projection, mostly cut away, of the tool of FIG. 1A.

In conjunction with channel 1*k*, the lock bolt piston ends comprise a valve means to resist drilling fluid flow therein. The resistance is responsive to configuration of the tool. In FIGS. 1A and 1B, the piston ends of the lock bolts do not protrude into channel 1*k* and this minimum resistance is indicative of the straight configuration after the lock bolts have extended. In FIGS. 2A and 2B, only the lower lock bolts move radially outward, lock bolts 4*a* intrude into channel 1*k* and produce a drilling fluid flow resistance related to the deflected (bent or directional) configuration. A condition not shown will exist when the tool is between the two axial extreme positions shown. No lock bolt will be aligned with a socket and all will protrude into and cause additional flow resistance in channel 1*k*. This maximum resistance will indicate a transition condition. This simple signal valve means will indicate at the earth surface the configuration of the tool downhole by influencing the drilling fluid flow rate to pressure ratio at the standpipe.

The tool has been described with an upper end and a lower end for descriptive convenience. In use, either and may be used upward in the drill string.

The lock bolts have been arranged for detent forces to provide the bias to move them radially inward for change of tool configuration. This is preferred to prevent unwanted changes in the tool configuration each time drilling fluid pressure is reduced below a certain amount. The lock bolts can obviously be spring biased inward by features well known in the machine construction art.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. A drilling assembly for use as a segment of a drill string in downhole well drilling applications for deflecting the drill string centerline to select straight hole or directional drilling configuration of a downhole assembly by manipulation of drilling controls at the surface, apparatus comprising:

(a) an elongated body, having a first end and a second end, each end having means for fluid tight attachment to a continuing drill string, with at least one fluid channel to conduct drilling fluid through the length of said body, said body comprising a first portion, having a longitudinal axis, and a second portion, having a longitudinal axis, said two axes being generally concentric when the drilling assembly is in said straight hole configuration;

(b) said first portion comprising said first end and an opposite end with an extension of reduced transverse dimension, and a first shoulder therebetween;

(c) said second portion comprising said second end and an opposite end with a second shoulder and an opening arranged to telescopingly receive said extension for limited axial movement therein between a first position, a corresponding to a minimum overall body length, and a second position, corresponding to a maximum overall body length, for limited rotation about a transverse axis to deflect said axis in said second portion relative to said axis in said first portion;

(d) rotational coupling means comprising non-circular surfaces on each said portions arranged to cooperate to prevent relative rotation therebetween;

(e) cam surfaces on each of said shoulders situated to engage and cooperate to urge said portions in opposite radial directions when said first portion is in said first position;

(f) fulcrum means on said extension, some distance from said first shoulder arranged to engage said second portion to deflect said axis in said first portion from said axis in said second portion when said first portion is in said first position;

(g) a plurality of sprockets in the wall of said opening with each socket opening radially inward therefrom;

(h) four lock bolts, each situated to operate as fluid power pistons in a transverse bore in said extension and to extend therefrom to engage said sockets, two of which extend in generally opposite radial directions from the other two and arranged such that two of said lock bolts engage said sockets when said second portion is in one of said first or said second positions and four said lock bolts engage said sockets when said second portion is in the other of said first or said second positions; and (i) fluid communication means between said channel and said bores such that fluid pressure in said channel will urge said lock bolts radially therefrom.

2. A drilling assembly for use as a segment of a drill string in downhole well drilling applications for deflecting the drill string centerline to select straight hole or directional drilling configuration of a downhole assembly by manipulation of drilling controls at the surface, apparatus comprising:

(a) an elongated body, having a first end and a second end, each end having means for fluid tight attachment to a continuing drill string, with at least one fluid channel to conduct drilling fluid through the length of said body, said body comprising a first portion, having a longitudinal axis, and a second portion, having a longitudinal axis, said two axes being generally concentric when the drilling assembly is in said straight hole configuration;

(b) said first portion comprising said first end and an opposite end with an extension of reduced transverse dimension, and a first shoulder therebetween;

(c) said second portion comprising said second end and an opposite end with a second shoulder and an opening arranged to telescopingly receive said extension for limited axial movement therein between a first position, corresponding to a minimum overall body length, and a second position, corresponding to a maximum overall body length, for limited rotation about a transverse axis to deflect said axis in said second portion relative to said axis in said first portion;

(d) rotational coupling means comprising non-circular surfaces on said portions arranged to cooperate to prevent relative rotation therebetween;

(e) cam surfaces on each of said shoulders situated to engage and cooperate to urge said portions in opposite radial directions when said first portion is in said first position;

(f) fulcrum means on said extension, some distance from said first shoulder arranged to engage said second portion to deflect said axis in said first portion from said axis in said second portion when said first portion is in said first position;

(g) a plurality of sockets in the wall of said opening with each socket opening radially inward therefrom;

(h) a plurality of lock bolts, each situated in a transverse bore in said extension, positioned such that a socket engagement end of said bolt can extend radially from said extension to engage one of said socket when said first portion is in said first position and another of said sockets when said first portion is in said second position, said bolt having a piston end arranged to cooperate with said bore to function as a force cylinder, said piston end on at least one said lock bolts arranged to extend into said channel and increase resistance to fluid flow therethrough when said lock bolt is not extendid to engage said socket; and (i) said fluid communication means between said channel and said bores such that pressure in said channel will urge said bolts radially therefrom.

3. A drilling assembly for use as a segment of a drill string in downhole well drilling applications for deflecting the drill string centerline to select straight hole or directional drilling configuration of a downhole assembly by manipulation of drilling controls at the surface, apparatus comprising:

(a) an elongated body, having a first end and a second end, each end having means for fluid tight attachment to a continuing drill string, with at least one fluid channel to conduct drilling fluid through the length of said body, said body comprising a first portion, having a longitudinal axis, and a second portion, having a longitudinal axis, said two axes being generally concentric when the drilling assembly is in said straight hole configuration;

(b) said first portion comprising said first end and an opposite end with an extension of reduced transverse dimension, and a first shoulder therebetween;

(c) said first portion comprising said second end and an opposite end with a second shoulder and an opening arranged to telescopingly receive said extension for limited axial movement therein between a first position, corresponding to a minimum overall body length, and a second position, corresponding to a maximum overall body length, for limited rotation about a transverse axis to deflect said axis in said second portion relative to said axis in said first portion;

(d) rotational coupling means comprising non-circular surfaces on each said portions arranged to cooperate to prevent relative rotation therebetween;

(e) cam surfaces on each of said shoulders situated to engage and cooperate to urge said portions in opposite radial directions when said first portion is in said first position;

(f) fulcrum means on said extension, some distance from said first shoulder arranged to engage said second portion to deflect said axis in said first portion from said axis in said second portion when said first portion is in said first position;

(g) a plurality of sockets in the wall of said opening with each socket opening radially inward therefrom;

(h) at least one lock bolt situated in a transverse bore in said extension, positioned such that a socket engagement end of said bolt can extend radially from said extension to engage one of said sockets when said first portion is in said first position and another of said sockets when when said first portion is in said second position, said bolt having a piston end arranged to cooperate with said bore to function as a force cylinder;

(i) fluid communication means between said channel and said bore such that pressure in said channel will urge said bolt radially therefrom; and (j) a washpipe, comprising a part of said channel, arranged for sealed sliding engagement with one of said portions and sealingly attached to the other of said portions, said sliding engagement limited to limit said maximum overall body length.

4. A drilling assembly for use as a segment of a drill string in downhole well drilling applications for deflecting the drill string centerline to select straight hole or directional drilling configuration of a downhole assembly by manipulation of drilling controls at the surface, apparatus comprising:

(a) an elongated body, having a first end and a second end, each end having means for fluid tight attachment to a continuing drill string, with at least one fluid channel to conduct drilling fluid through the length of said body, said body comprising a first portion, having a longitudinal axis, and a second portion, having a longitudinal axis, said two axes being generally concentric when the drilling assembly is in said straight hole configuration;

(b) said first portion comprising said first end and an opposite end with an extension of reduced transverse dimension, and a first shoulder therebetween;

(c) said second portion comprising said second end and an opposite end with a second shoulder and an opening arranged to telescopingly receive said extension for limited axial movement therein between a first position, corresponding to a minimum overall body length, and a second position, corresponding to a maximum overall body length, for limited rotation about a transverse axis to deflect said axis in said second portion relative to said axis in said first portion;

(d) rotational coupling means comprising non-circular surfaces on each said portions arranged to cooperate to prevent relative rotation therebetween;

(e) cam surfaces on each of said shoulders situated to engage and cooperate to urge said portions in opposite radial directions when said first portion is in said first position;

(f) fulcrum means on said extension, some distance from said first shoulder arranged to engage said second portion to deflect said axis in said first portion from said axis in said second portion when said first portion is in said first position;

(g) a plurality of sockets in the wall of said opening with each socket opening radially inward therefrom;

(h) at least one lock bolt situated in a transverse bore in said extension, positioned such that a socket engagement end of said bolt can extend radially from said extension to engage one of said sockets when said first portion is in said first position and another of said sockets when when said first portion is in said second position, said bolt having a piston end arranged to cooperate with said bore to function as a force cylinder;

(i) fluid communication means between said channel and said bore such that pressure in said channel will urge said bolt radially therefrom; and (j) valve means situated in said body, arranged to resist the flow of drilling fluid therethrough, operatively connected to at least one of said lock bolts to move in sympathy therewith to provide drilling fluid flow resistance in said channel that is representative of the position of said lock bolt.

* * * * *